United States Patent [19]

Huber

[11] 4,145,040

[45] Mar. 20, 1979

[54] GRIPPER DRUM

[75] Inventor: Ernst Huber, Wettingen, Switzerland

[73] Assignee: Gretag Aktiengesellschaft, Regensdorf, Switzerland

[21] Appl. No.: 831,294

[22] Filed: Sep. 7, 1977

Related U.S. Application Data

[63] Continuation of Ser. No. 729,152, Oct. 4, 1976, abandoned.

[30] Foreign Application Priority Data

Oct. 10, 1975 [CH] Switzerland ..... 13214/74

[51] Int. Cl.[2] ..... B65H 5/12

[52] U.S. Cl. ..... 271/276; 271/195; 271/196

[58] Field of Search ..... 271/276, 196, 94, 96, 271/108, 195; 198/689; 226/95

[56] References Cited

U.S. PATENT DOCUMENTS

| | | | |
|---|---|---|---|
| 2,528,123 | 10/1950 | Dyken | 271/96 X |
| 2,630,956 | 3/1953 | Pomeroy et al. | 198/689 X |
| 3,127,168 | 3/1964 | Kramer | 271/96 |

FOREIGN PATENT DOCUMENTS

| | | | |
|---|---|---|---|
| 579116 | 6/1933 | Fed. Rep. of Germany | 271/96 |
| 2109237 | 9/1972 | Fed. Rep. of Germany | 271/196 |

*Primary Examiner*—Bruce H. Stoner, Jr.
*Attorney, Agent, or Firm*—Burns, Doane, Swecker & Mathis

[57] ABSTRACT

A gripper drum having in the peripheral surface thereof a number of apertures aligned in rows running parallel to the rotational axis of the drum, the rows defining an active suction zone. Each row of apertures is connected to a duct located below the surface of the drum and each duct is connected by a conduit to a bore in a stationary part of the drum, the bore being connected to a source of suction so that as the drum rotates about the inner stationary part suction is applied to the apertures. Pistons, one for each duct, are mounted on a plate which can be moved to insert the pistons into one end of each duct respectively, the opposite ends of the ducts being closed thereby sealing off the apertures from the suction source and altering the width of the active suction zone on the periphery of the drum. The conduits are connected to positions on the ducts progressively remote from the ends into which the pistons are inserted. The drum can comprise an annular outer part, having the apertures, ducts and conduits, which rotates about a stationary cylindrical part having a groove in its periphery connected to the bore for the suction source. The conduits are aligned with the groove so that on rotation of the outer part suction is applied first to one row of apertures and then to succeeding rows.

5 Claims, 6 Drawing Figures

GRIPPER DRUM

This is a continuation, of Application Ser. No. 729,152, filed Oct. 4, 1976, now abandoned.

FIELD OF THE INVENTION

This invention relates to a gripper drum for sheet material.

Rotary suction gripper drums are frequently used in paper processing and printing machines to make a fold or to convey sheets from one part of the machine to another part. They have also recently been used in quality control equipment for printed products where they are used for moving such products past the measuring heads of colour measuring or other testing and monitoring equipment.

PRIOR ART

Both in paper processing and in printing quality control it is frequently desirable and sometimes necessary to be able to vary the size and/or shape of the suction zone of the drum to enable paper sheets of different formats to be properly gripped by the drum. This format adjustment should be possible as quickly and as easily as possible and without any interruption in the operation of the machine in which the drum is used.

A gripper drum which already satisfies these requirements to some degree is disclosed in German Pat. No. 579,116. In this suction drum, ducts extend beneath and communicate with corresponding rows of suction slots from one end face of the drum to the other, each duct being connected to a common suction conduit via a radial connecting bore substantially at its centre. Axially adjustable sealing studs are introduced into the ducts from both end faces and depending on their axial position cover the suction slots to varying degrees and thus de-activate them. Individual adjustment of the individual sealing studs thus enables practically any shape to be obtained for the active suction zone of the drum and the position of the active suction zone varied within certain limits.

Although this known suction drum offers variations in size and position of the active suction zone, the individual adjustment of the numerous sealing studs can be tedious and time-consuming, and is only possible while the drum is stationary.

BRIEF SUMMARY OF THE INVENTION

One of the objects of this invention is to provide an improved suction gripper drum having means for varying the size of the active suction zone.

According to one aspect of the invention, the orifice of the connecting conduit is situated nearer the adjustable sealing stud or piston insertion end of the duct of those ducts situated nearer one peripheral zone edge than those ducts more remote from that peripheral zone edge, the distance between the orifice of the connecting conduit and the piston insertion end of the duct increasing linearly away from the peripheral zone edge towards the middle of the zone, and means are provided for adjusting the position of all the sealing pistons within the ducts.

Although the principle of adjusting all the sealing pistons may appear trivial, it cannot be applied, for example, to the suction drum described hereinbefore, since in that case it would automatically result in a restriction of the possible format variations to just a single dimension and this would be inadequate for most applications. A two-dimensional change of format of the active suction zone of the drum can be obtained with the arrangement according to one aspect of this invention in which the orifices of the connecting conduit are at different distances from the duct ends, so that it is only in this way that the conditions can be obtained for a successful application of the adjustment principle.

Another problem with the suction drums hitherto used in monitoring equipment arises because in these suction drums all the active suction slots are simultaneously connected to or disconnected from the suction source. Consequently, in such drums the sheet material cannot be gripped or clamped progressively away from the front edge, instead each sheet must first be accurately guided to that part of the drum provided with suction slots and then be sucked firmly as a whole against the drum surface by applying vacuum to all the suction slots. Consequently, the available drum surface cannot be utilized to the optimum extent for the provision of measuring and testing heads. Nor is it possible with these known suctions drums to lift the front edges of the sheets away from the drum while their rear portions are still gripped. This is difficult particularly if the sheet material is to be gripped successively on a number of gripper drums and the space available makes it impossible to arrange the drums so that the circumferential length is not equal to at least one full sheet length between the place where the sheet material reaches the drum surface and the place where it leaves the same again.

All these difficulties and disadvantages are obviated according to another feature of the invention which comprises a movable part containing the suction slots, ducts and connecting conduits and a stationary part provided with a connection for the suction source, the two parts being interconnected in sealing-tight relationship along two sealing surfaces, all the connecting conduits lead into the sealing surface of the movable drum part in such a manner that they move along one and the same path with respect to the stationary drum part, and the sealing surface of the stationary drum part has a groove which extends along this path of movement and is connected to the suction source.

Although German Offenlegungsschrift No. 2 109 237 discloses a suction drum in which the suction slots are connected to the suction source only over a certain angular zone of the drum rotation, the drum has only a single row of suction slots parallel to the axis of rotation and is therefore a priori unsuitable for use in monitoring and test equipment.

BRIEF DESCRIPTION OF DRAWINGS

Preferred embodiments of the invention will be explained in detail hereinafter with reference to the accompanying drawings wherein.

DETAILED DESCRIPTION OF PREFERRED EMBODIMENTS

Figure 1:
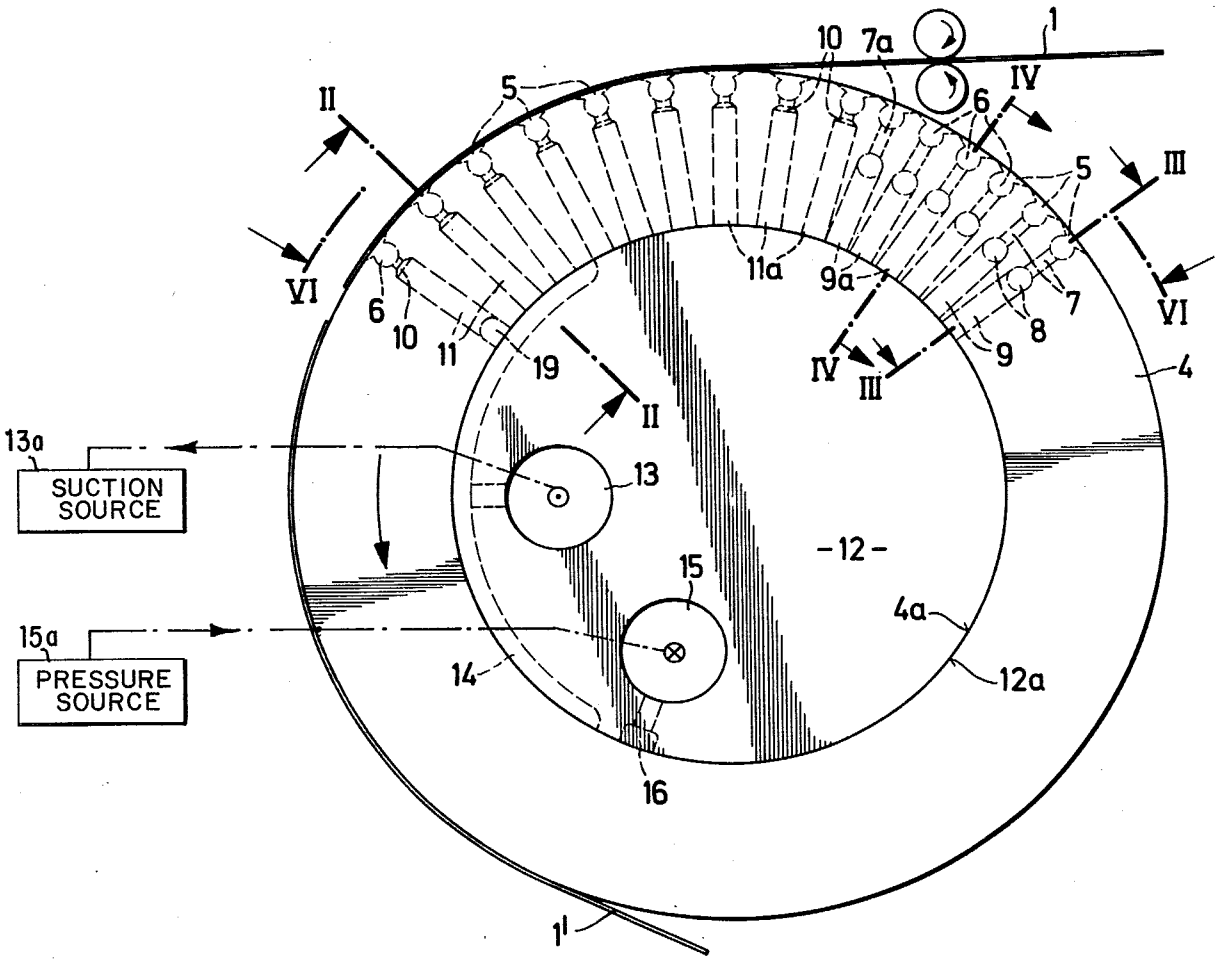
FIG. 1 is an end view of a gripper drum in accordance with this invention.

The gripper drum shown in FIG. 1 comprises a stationary inner part 12 and a rotatable outer part 4. The inner part 12 contains a suction conduit 13 connected to a suction source 13*a* and an air supply conduit 15 connected to a pressurized air source 15*a*. A peripheral groove 14 serving as a conduit is provided in the drum surface 12*a* and extends over approximately one-third of the periphery of the inner part 12 and is connected to the suction conduit 13. A recess 16 is provided adjoining the peripheral groove 14 and is axially offset from the latter and connected to the air supply conduit 15. A suction source and a pressure source are respectively connected during operation to the suction conduit 13 and to the air supply conduit 15.

Figure 2:
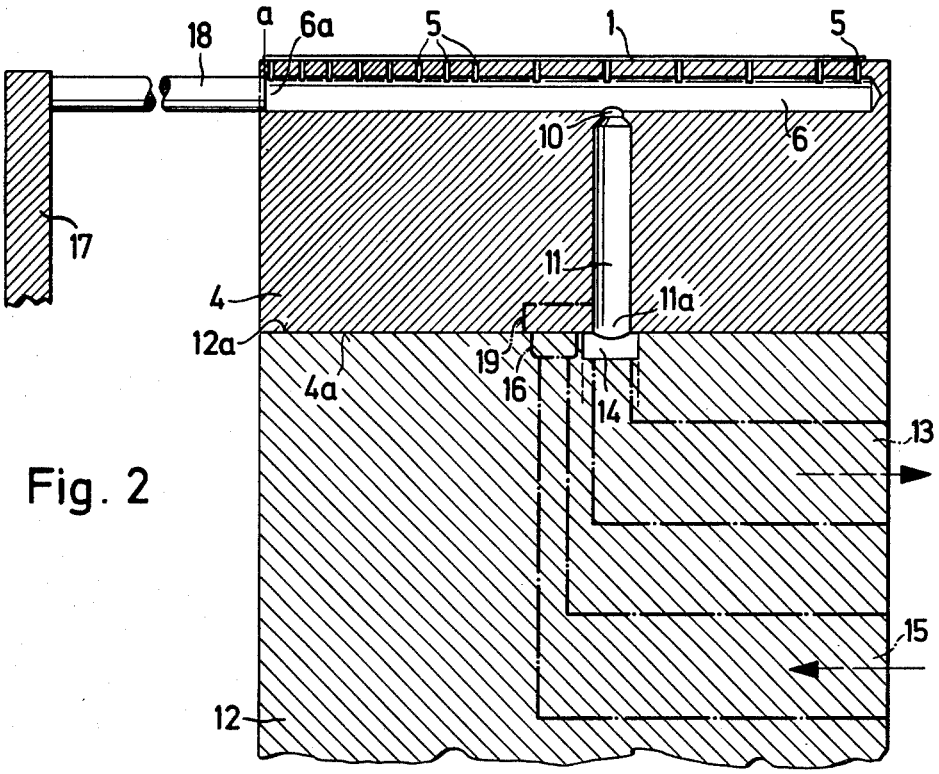
FIGS. 2 to 4 are each sections along the line II—II, III—III, and IV—IV in FIG. 1.
Figure 3:
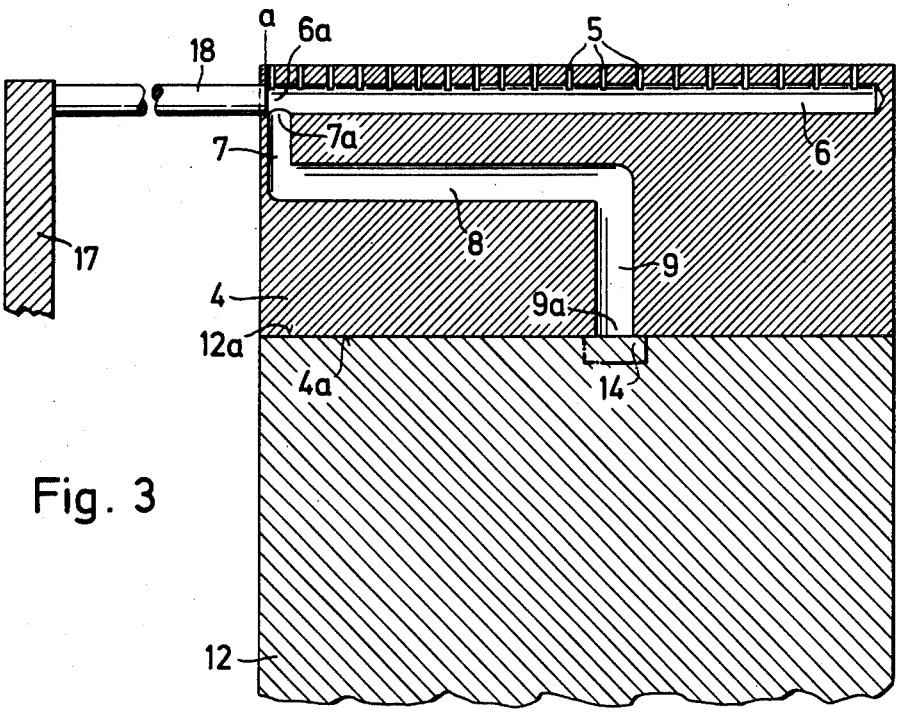
Figure 4:
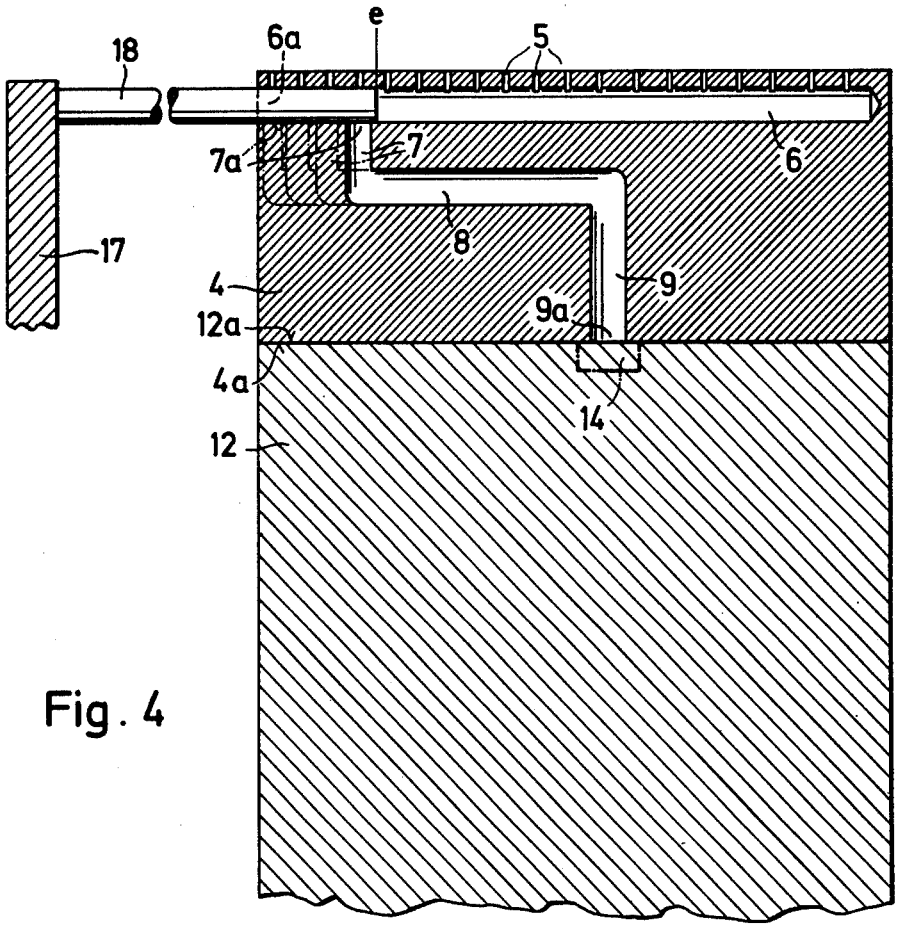
Figures 5, 6:
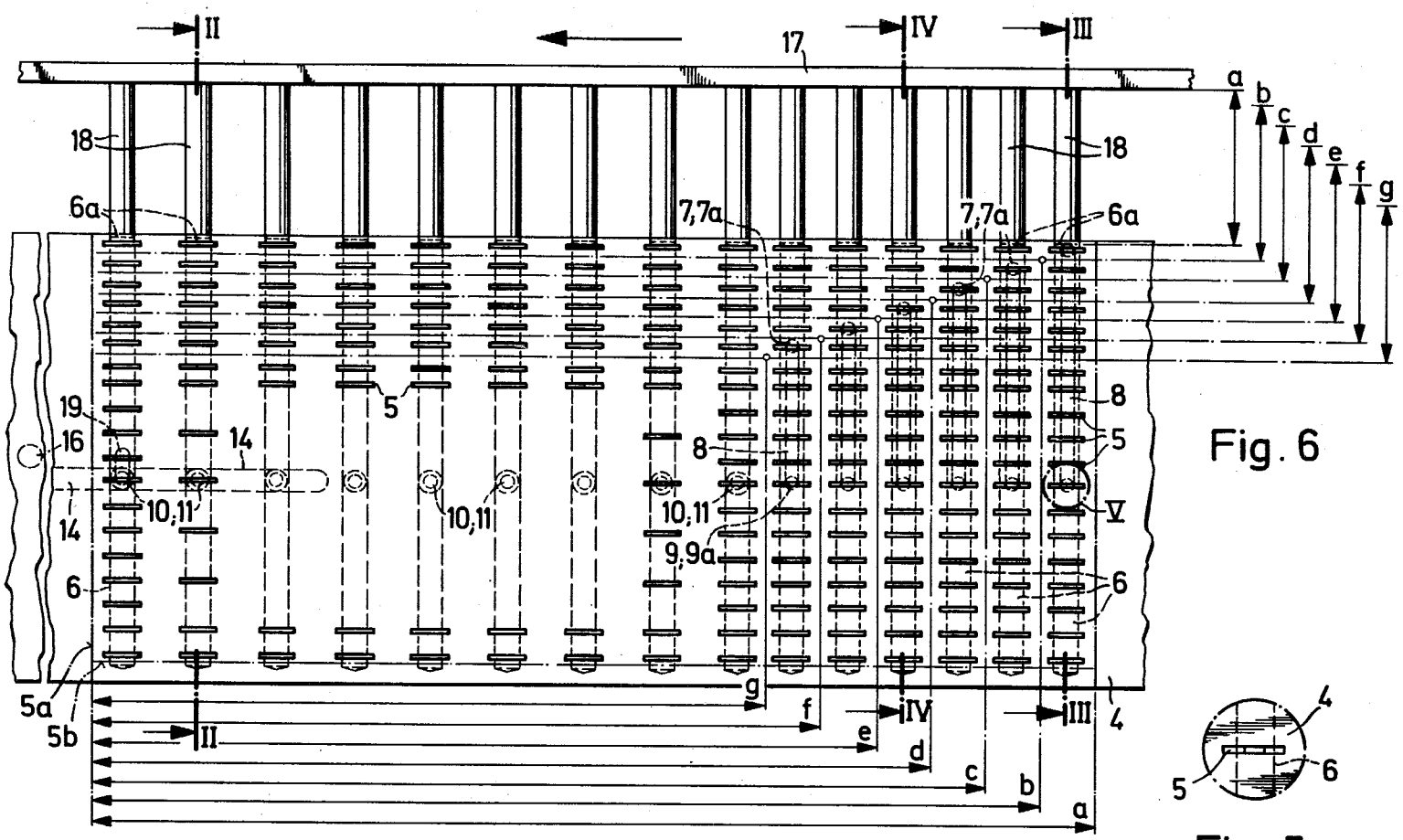
FIG. 5 is a detail of FIG. 6.
FIG. 6 is a partial development of the gripper drum shown in FIG. 1.

Just below its peripheral surface, the rotatable outer drum part 4 has a number of ducts 6 parallel to the axis of rotation of the drum. The ducts 6 are closed at one end and the opposite ends all open out into the same end face of the drum, namely the left-hand end as shown in FIGS. 2, 3 and 4 to receive pistons 18 to be later described. A plurality of elongate suction slots 5 are formed in the drum surface and their shape and arrangement is shown in FIGS. 1, 5 and 6. Adjacent slots 5 are each connected to the associated ducts 6 situated therebeneath, so as to communicate therewith.

The front nine ducts 6 as considered in the direction of rotation of the outer drum part 4 defined by the arrow in FIG. 1 are each connected to a different one of radial bores 11, each of which is constricted somewhat at its radially outward end 10 and leads at the point 11*a* into the inner surface 4*a* of the outer drum part 4. The axial position of these bores 11 coincides with that of the peripheral groove 14, so that the slots 5 of a duct 6 are connected to the suction conduit 13 when the bore 11 associated with this duct is situated in the region of the peripheral groove 14. The foremost bore 11 is provided with a widening 19 (shown in broken lines in FIG. 6) or a bypass or the like so constructed as to sweep over the recess 16 in the inner part 12 of the drum and thus connect the foremost duct 6 to the air supply conduit 16 via the bore 11 when the outer drum part 4 is in the appropriate position.

The remaining ducts 6 are connected by conduits which also lead to the peripheral groove 14. Unlike the bores 11, these conduits do not extend radially outwards from the peripheral groove 14, but are made up of two radial portions 7, 9 which are axially offset from one another, and a connecting portion 8 parallel to the axis of rotation of the drum. The lengths of the connecting portions 8 are graduated and increase linearly from front to rear in such a manner that the orifice 7*a* of the radial portion 7 of the last one of the ducts 6 is just in front of the end face of the drum as shown in FIGS. 3, 4 and 6. The orifices of the radial portions 9 in the inner surface 4*a* of the outer part 4 of the drum have been given the reference 9*a*.

A plate 17 having a number of pistons 18 corresponding to the number of ducts and of equal length is disposed adjacent the left hand end of the rotatable outer part 4 of the drum and these pistons project into the duct ends 6*a* and hermetically seal off all the slots 5, along that part of the piston within the duct and the orifice 7*a* of conduit portion 7. The depth of penetration of the pistons 18 into the duct 6 is adjustable by the plate 17. In FIG. 6, seven possible positions of the pistons are indicated by the lower-case letters a to g.

As will be clear from FIGS. 2 to 4, the number of suction slots 5 gradually connected to the suction conduit 13 during rotation of the outer drum part 4 can be varied by varying the depth of insertion of the pistons 18 into the ducts 6. In the outermost position a (FIG. 6), all the slots are operative, while in the innermost position g, only the slots situated within a small surface area are connected to the suction conduit. The gripper drum can thus be adapted to different formats of sheet material 1 requiring to be gripped by adjusting the position of piston plate 17 relative to one end of the drum. At the same time the front boundary line (5*a*) and a lateral boundary line (5*b*) of the activated suction zone shown in FIG. 6 remain fixed in each case. Other sealing means adjustable within the ducts could be provided instead of the pistons 18.

The gripper drum requires no control system for switching the suction on and off, it can be permanently connected to a suction source and a pressure source and may also move continuously. Activation and de-activation of the suction slots take place automatically as a result of the rotary movement of the outer drum part; the slots are not all connected simultaneously to the suction source; instead they are connected gradually. It is thus possible for sheets fed to the gripper drum to be immediately clamped fast by their front edge and then gradually be drawn onto the drum as rotation continues.

As soon as the foremost bore 11 connects the foremost duct 6 to the air supply conduit 15 via the recess 16, the front edge of the sheet (sheet 1') is released from the drum surface and can be gripped, for example, by any conveyor device or another gripper drum. It is not until then that the rear part of the sheet is gradually released. Depending on the length of the peripheral groove 14, it is possible not to clamp the sheet over its entire surface, but grip it in such a way that its front edge already starts to be released from the drum even before its rear end is clamped. An arrangement of this kind may be very advantageous, for example, in constricted space conditions. A very high speed of operation is also possible as a result.

The above-described successive and continuous gripping of sheet material is of course also advantageous in the case of gripper drums with or without a different kind of format adjustment.

In the above-described exemplified embodiment there is only one system of bores 11, ducts 6 and suction slots 5 which extends over part of the periphery of the drum corresponding to the length of the sheet material. It is, however, possible to provide a plurality of such systems to increase speed and, for a given drum diameter, the repetition frequency at which sheets are gripped. Grooves and recesses corresponding to the groove 14, and the recess 16 in the inner drum part 12 may also be provided so that a number of sheets can be gripped on the drum simultaneously.

What is claimed is:

1. A gripper drum having a peripheral surface, end faces and an axis of rotation;

a plurality of ducts disposed below said peripheral surface and extending from one end face parallel with said axis;

a plurality of apertures in said peripheral surface arranged in rows parallel to said axis, all of the apertures in each said row opening only into a correspondingly located duct, said rows of apertures forming on said peripheral surface an active suction zone having two opposite boundary lines each defined by one row of the apertures;

a conduit means for connection of a suction source;

conduits each coupling the conduit means to a different one of said ducts; and means for selectively sealing off the apertures in a row from said conduit means; wherein said conduits couple the duct connected to that row of apertures nearest to at least one of said boundary lines of said zone near said one end face to said conduit means and the remaining ducts at positions which are further away from said one end face.

2. A gripper drum according to claim 1, wherein said sealing means comprises a plurality of pistons, each of which is slidingly movable in a corresponding duct and in sealing engagement with the inner surface of the latter, and a common bearer mounting said pistons.

3. A gripper drum according to claim 2 wherein the distances between said one end face and the positions of said conduits increase only from one zone edge towards the middle of the zone.

4. A gripper drum according to claim 1 wherein said drum comprises a stationary inner cylindrical part and an outer annular part rotatable about said inner part in sealing engagement therewith;

said outer annular part having said apertures, ducts, and conduits;

said inner part having said conduit means and, in its outer circumferential surface, a first groove which is coupled to said conduit means; and wherein said conduits in said outer part of said drum are each positioned to register with said first groove so that upon rotation of said outer part about said inner part the apertures are coupled via said ducts, conduits and first groove to said conduit means.

5. A gripper drum according to claim 4 wherein said first groove is formed only part way around the outer circumferential surface of said inner part, said inner part further comprising a supply conduit for a pressure source and a second groove located in said outer circumferential surface of said inner part after said first groove considered in the direction of rotation of said outer part and connected to said supply conduit, wherein said first and second grooves lie in planes transverse to the axis of rotation of said outer part, the plane of said first groove being axially spaced from the plane of said second groove; said outer annular part further comprising a by pass means opening into that conduit which couples the first duct considered in the direction of rotation to said conduit means and being positioned to register with said second groove so that upon rotation of said outer part about said inner part all of said ducts are first successively connected to said conduit means and then said first duct is connected to said supply conduit.

* * * * *